US006323592B1

(12) United States Patent
Takahashi et al.

(10) Patent No.: US 6,323,592 B1
(45) Date of Patent: Nov. 27, 2001

(54) CATHODE RAY TUBE AND METHOD OF MANUFACTURING CONDUCTIVE ANTIREFLECTION FILM

(75) Inventors: Yoshinori Takahashi, Saitama-ken; Tsuyoshi Oyaizu; Hidemi Matsuda, both of Fukaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/274,206

(22) Filed: Mar. 23, 1999

(30) Foreign Application Priority Data

Mar. 23, 1998 (JP) ..... 10-074594

(51) Int. Cl.[7] ..... H01J 29/92

(52) U.S. Cl. ..... 313/479; 313/313; 313/478; 348/818; 315/85

(58) Field of Search ..... 313/479, 477 R, 313/478, 313; 348/818, 819; 315/85; 428/356; 445/45

(56) References Cited

U.S. PATENT DOCUMENTS 4,785,217 11/1988 Matsuda et al. ..... 313/479
5,025,490 * 6/1991 Tamura ..... 313/479
5,246,771 * 9/1993 Kawaguchi ..... 428/261
5,757,117 * 5/1998 Hirasawa et al. ..... 313/479

FOREIGN PATENT DOCUMENTS 0 554 115 A1 8/1993 (EP) .
9-248935 9/1997 (JP) .
WO 95/14289 5/1995 (WO) .

* cited by examiner

*Primary Examiner*—Michael H. Day
*Assistant Examiner*—Matthew J Gerike
(74) *Attorney, Agent, or Firm*—Pillsbury Winthrop LLP

(57) ABSTRACT

Disclosed is a conductive antireflection film comprising a laminate structure consisting of a conductive layer and an insulating covering layer covering the surface of the conductive layer and a conductive member connected at one end to the conductive layer and exposed at the other end to the outside. The conductive member is brought into contact with an electrolytic solution so as to control the state of the metal contained in the conductive layer, making it possible to prevent effectively an electromagnetic wave from leaking to the outside and to obtain a clear image of a high contrast.

11 Claims, 2 Drawing Sheets

CATHODE RAY TUBE AND METHOD OF MANUFACTURING CONDUCTIVE ANTIREFLECTION FILM

BACKGROUND OF THE INVENTION

The present invention relates to a cathode ray tube such as a color television tube equipped with an antireflection film and a method of manufacturing a conductive antireflection film used in a cathode ray tube, etc.

In recent years, a serious problem is pointed out in a cathode ray tube such as a Brawn tube for a color television tube or a CRT for a computer. It is pointed out that an electromagnetic wave generated in the vicinity of the electron gun and deflection yoke within the cathode ray tube leaks to the outside so as to affect electronic equipment arranged around the cathode ray tube. In order to prevent the electromagnetic wave from leaking to the outside, a conductive antireflection film is formed on the surface of the face panel of the cathode ray tube.

Such a conductive antireflection film is disclosed in, for example, U.S. Pat. No. 4,785,217. Specifically, disclosed is a conductive antireflection layer consisting of an antireflection film containing particles of at least one of metals selected from the group consisting of Pd, Sn, Pt, Ag, and Au together with a metal oxide.

The conductive antireflection film is required to be capable of preventing the electromagnetic wave from leaking to the outside and, at the same time, to be capable of achieving a high contrast in order to enable the cathode ray tube to display a clear picture image.

The high contrast can be achieved by improving the light transmittance of the conductive antireflection film. However, if the conductive film is formed thin for improving the light transmittance in the conventional cathode ray tube, the density of the metal fine particles is lowered, resulting in failure to obtain a sufficient electrical conductivity. As a result, it is difficult to prevent the electromagnetic wave from leaking to the outside. On the other hand, if the thickness of the conductive film is increased in an attempt to improve the electrical conductivity, the density of the metal fine particles is increased, leading to a low light transmittance.

It should also be noted that, in the conventional conductive antireflection film, the fine particles of silver, silver-palladium alloy, etc. contained in the film causes the film to strongly absorb light having a wavelength of about 400 nm to 500 nm. It follows that the body color is rendered yellowish and poor in contrast, making it difficult to obtain a clear picture image.

BRIEF SUMMARY OF THE INVENTION

The present invention, which has been achieved for overcoming the above-noted difficulties inherent in the prior art, is intended to provide a cathode ray tube which permits preventing an electromagnetic wave from leaking to the outside and which also permits obtaining a clear image of a high contrast.

The present invention is also intended to provide a method of manufacturing a conductive antireflection film having a high electrical conductivity and excellent in light transmittance.

According to an aspect of the present invention, there is provided a cathode ray tube, comprising:

a faceplate; and a conductive antireflection film including a conductive layer formed on the faceplate, an insulating covering layer formed on the conductive layer, and a conductive member formed in the insulating covering layer in a manner to extend from the surface of the insulating covering layer into the conductive layer, a part of the conductive member being electrically connected to the conductive layer and another part being exposed to the outside.

According to another aspect of the present invention, there is provided a method of manufacturing a conductive antireflection film, comprising the steps of:

forming a conductive layer on a substrate;

forming an insulating covering layer on the conductive layer;

forming a conductive member in the insulating covering layer such that the conductive member extends from the surface of the insulating covering layer into the conductive layer so as to bring at least a part of the conductive member into electric contact with the conductive layer, with another part of the conductive member exposed to the outside;

bringing an electrolytic solution into contact with the exposed part of the conductive member; and removing the electrolytic solution.

Further, according to still another aspect of the present invention, there is provided a method of manufacturing a conductive antireflection film, comprising the steps of:

forming a conductive layer on a substrate having a conductive member formed therein in advance such that the conductive layer is brought into contact with a part of the conductive member;

forming an insulating covering layer to cover the conductive layer and the conductive member except another part of the conductive member to permit the another part of the conductive member to be exposed to the outside;

bringing an electrolytic solution into contact with the exposed part of the conductive member; and removing the electrolytic solution.

In the cathode ray tube of the present invention, the antireflection film includes a conductive member electrically connected to a conductive layer. Since the state of the metal contained in the conductive layer is controlled by the conductive member, the electromagnetic wave is prevented from leaking to the outside and a clear image of a high contrast can be obtained.

According to the method of the present invention for manufacturing a conductive antireflection film, a conductive member connected to a conductive layer is brought into contact with an electrolytic solution so as to control the state of the metal contained in the conductive layer, making it possible to obtain a conductive antireflection film having a high electrical conductivity and excellent in light transmittance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
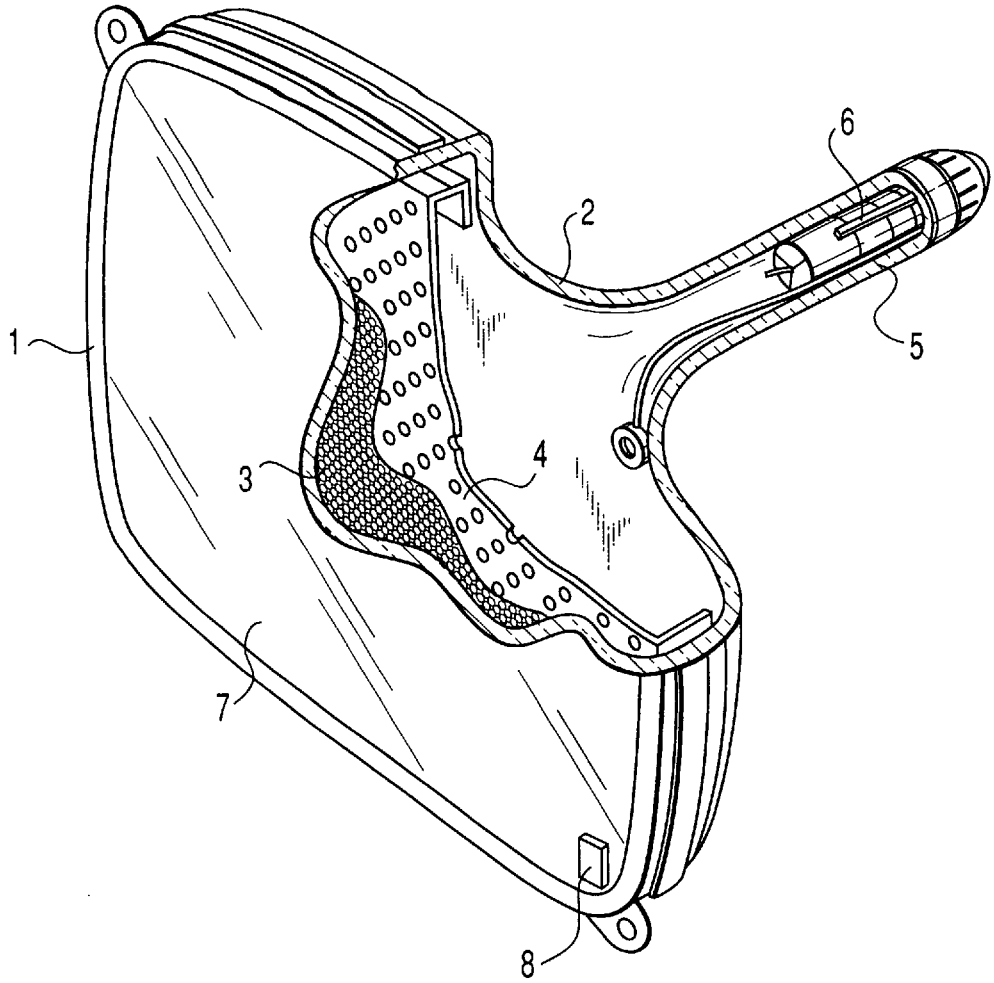
FIG. 1 shows the construction of a cathode ray tube according to one embodiment of the present invention.

The present invention includes first to third aspects. The first aspect of the present invention is directed to a cathode ray tube, comprising a faceplate and a conductive antireflection film formed on the faceplate, said conductive antireflection film including a conductive layer formed on the faceplate, an insulating covering layer formed on the conductive layer, and a conductive member formed in said insulating covering layer in a manner to extend from the surface of the insulating covering layer into said conductive layer, a part of said conductive member being electrically connected to the conductive layer and another part being exposed to the outside.

The second aspect is directed to a method of manufacturing an antireflection film which can be used in the cathode ray tube according to the first aspect of the present invention. The method comprises the steps of forming a conductive layer on a substrate, and forming an insulating covering layer on said conductive layer, the method further comprising the step of forming a conductive member in said insulating covering layer such that said conductive member extends from the surface of the insulating covering layer into said conductive layer so as to bring at least a part of said conductive member into electric contact with the conductive layer, with another part of the conductive member exposed to the outside, the step of burying a conductive member in at least said opening such that a part of said conductive member is brought into contact with said conductive layer and another part is exposed to the outside, the step of bringing an electrolytic solution into contact with at least the exposed part of the conductive member, and the step of removing said electrolytic solution.

Further, the third aspect of the present invention is directed to a method of manufacturing an antireflection film which can be used in the cathode ray tube according to the first aspect of the present invention. The method of the third aspect comprises the step of forming a conductive layer on a substrate having a conductive member formed therein in advance such that said conductive layer is brought into contact with a part of said conductive member, the step of forming an insulating covering layer to cover said conductive layer and said conductive member except another part of said conductive member to permit said another part of the conductive member to be exposed to the outside, the step of bringing an electrolytic solution into contact with the exposed part of said conductive member, and the step of removing said electrolytic solution.

In the cathode ray tube of the present invention, a conductive member is arranged in the conductive antireflection film. An electrolytic solution is brought into contact with the conductive member so as to control the state of the metal contained in the conductive layer. As a result, it is possible to obtain a conductive antireflection film having a high electrical conductivity and excellent in light transmittance. It follows that the electromagnetic wave is effectively prevented from leaking to the outside, and it is possible to obtain a clear image of a high contrast.

According to the method of the present invention for manufacturing a conductive antireflection film, a conductive member is formed in an insulating covering layer in a manner to be exposed partly to the outside, and the exposed portion of the conductive member is brought into contact with an electrolytic solution so as to control through the conductive member the state of the metal contained in the conductive layer. As a result, it is possible to manufacture a conductive antireflection film having a high electrical conductivity and excellent in light transmittance.

The conductive layer used in the present invention contains fine particles of metals such as Ag and Cu. The fine particles of the metal should preferably have an average particle diameter (average diameter of spheres having volumes equal to those of the fine particles) of about 10 to 1000 Å. If the average particle diameter is less than 10 Å, a sufficient conductivity cannot be obtained. On the other hand, if the average particle diameter exceeds 1000 Å, it is difficult to obtain a sufficient light transmittance.

The fine metal particles act as a medium for supporting the electron migration. It follows that, if the density of the fine metal particles within the conductive layer is high, the electrical conductivity of the conductive layer is improved.

For preparing the conductive layer, a glass plate or the like of a face panel is coated by a spin coating method, spray coating method or dipping method with a dispersion prepared by dispersing fine particles of Ag, Au, Pd, Cu, etc. in a solvent of ethanol, methanol, n-propanol, isopropanol, n-butanol, water, NMP, etc. In the coating step, it is desirable to set the temperature of the glass plate, etc. of the face panel at about 5 to 60° C. in order to suppress non-uniformity of the conductive layer and to obtain the conductive layer of a uniform thickness.

The thickness of the conductive layer should generally be set at about 100 Å to 10,000 Å in view of the light transmittance of the conductive layer. The thickness of the conductive layer can be easily controlled by controlling the concentration of the fine particles of metals such as Ag and Cu contained in the dispersion, the rotating speed in the coating step by the spin coating method, the discharge rate of the dispersion in the spray coating method, the pull-up rate in the dipping method, etc. After the coating step, the solvent of the dispersion is evaporated.

It is possible to add organometallic compounds, pigments, dyes, etc. to the conductive layer so as to impart additional functions to the conductive layer.

The final resistance of the conductive layer should be about $10^2$ to $10^5\Omega$ in order to suppress the leaking electric field. If the final resistance exceeds $10^5\Omega$, the leakage of electric field cannot be sufficiently suppressed.

The insulating covering layer covering the conductive layer, which serves to protect the conductive layer, contains as a main component an insulating material such as $SiO_2$, fluoroalkyl silane, etc. The covering layer can be formed by coating the conductive layer with, for example, an alkoxide solution of Si by means of a spin coating method, spraying method or dipping method.

It is desirable for the insulating covering layer to have a thickness of about 100 Å to 10,000 Å. If the thickness is less than 100 Å, a sufficient mechanical strength of the covering layer cannot be obtained, resulting in failure to protect the conductive layer sufficiently. On the other hand, if the thickness exceeds 10,000 Å, the covering layer is not adapted for use as an antireflection film, resulting in failure to obtain a sufficient antireflection function. The thickness of the covering layer can be controlled easily by controlling, for example, the viscosity of the solution, the Si concentration of an alkoxide solution, etc., the rotating speed in the coating step by the spin coating method, the discharge rate of the alkoxide solution in the spraying method, or the pull-up rate in the dipping method. After the coating step, the solvent is evaporated.

In general, the conductive layer and the insulating covering layer formed on the conductive layer are dried and, then, baked at 80 to 400° C. for 10 to 180 minutes so as to obtain a desired conductive antireflection film.

The alternating electric field (AEF) through which the electromagnetic field leaks can be roughly classified into an ELF band a VLF band. In order to shield the ELF band, it is important for the surface resistance of the conductive antireflection film to be lower than $1\times10^5\Omega$. Also, for shielding the VLF band, it is important for the surface resistance of the conductive antireflection film to be lower than $5\times10^2\Omega$.

Further, the type of arrangement of the conductive member included in the conductive antireflection film is not particularly limited as far as a part of the conductive member is electrically connected to the conductive layer and another part is exposed to the outside. For example, it is possible to arrange the conductive member in contact with the conductive layer such that the conductive member extends through the covering layer. Alternatively, in forming a conductive antireflection film on the glass plate, etc. of the face panel, a conductive member consisting of, for example, an ITO film is formed in advance on the glass plate of the face panel. In this case, it is possible to laminate the conductive antireflection film on the conductive member consisting of the ITO film.

It is possible to arrange the conductive member anywhere of the conductive antireflection film. However, it is desirable to arrange the conductive member at the position where the visibility of the cathode ray tube is not impaired, e.g., in the outer peripheral portion of the display panel of the cathode ray tube. The conductive member may be circular, elliptical, rectangular or of any optional shape. It is possible to determine appropriately the shape of the conductive member in view of the specification of the cathode ray tube and the environment in which the cathode ray tube is used.

It is desirable for the that portion of the conductive member which is exposed to the outside through the covering layer to have a surface area of about 1 to 100 $mm^2$. It is possible to arrange a single conductive member in the conductive antireflection film. It is also possible to arrange a plurality of conductive members in the conductive antireflection film, as desired.

The conductive member should desirably exhibit a conductivity of $15^5\Omega/\square$ or less. Various conductive materials such as ITO, metals and conductive organic compounds can be used for forming the conductive member.

In the method of the present invention for manufacturing a conductive antireflection film, how to form the conductive member is not particularly limited as far as the conductive member is partly connected electrically to the conductive layer and is exposed partly to the outside. For example, a laminate structure consisting of the conductive layer and the covering layer is baked first, followed by forming the conductive member consisting of, for example, solder. Alternatively, a conductive member consisting of, for example, an ITO film is formed in advance on the glass plate, etc. of the face panel, followed by successively laminating the conductive layer and the covering layer on the conductive member consisting of the ITO film.

An electrolytic solution is brought into contact with the conductive member, as described herein later. Therefore, a material stable against the electrolytic solution is selected for forming the conductive member.

The conditions for bringing an electrolytic solution into contact with the conductive member are not particularly limited as far as an oxidation-reduction reaction is carried out between the conductive member and the electrolytic solution. It is desirable for the electrolytic solution to contain an electrolyte which does not corrode the conductive member and which is excellent in stability. To be more specific, the electrolytic solution should desirably contain at least one ion selected from the group consisting of $K^+$, $Ba^{2+}$, $Ca^{2+}$, $Na^+$, $Mn^{2+}$, $Zn^{2+}$, $Cr^{3+}$, $Fe^{2+}$, $Cu^{2+}$, and $Cl^-$. The concentration of the electrolytic solution and the contact time between the conductive member and the electrolytic solution can be determined appropriately based on the environments and conditions for manufacturing the conductive antireflection film.

Let us describe in detail the cathode ray tube and the method of manufacturing a conductive antireflection film of the present invention with reference to the accompanying drawings.

FIG. 1 shows the construction of a cathode ray tube according to one embodiment of the present invention. As shown in the drawing, the cathode ray tube comprises an envelope consisting of a panel 1 and a funnel 2 formed integrally with the panel 1. A phosphor screen 3 consisting of three phosphor layers emitting blue, green and red lights, respectively, and a black light-absorbing layer filling the clearances among the three phosphor layers is formed inside the panel 1. These three phosphor layers can be formed by the ordinary method such as a slurry method. To be more specific, the inner surface of the panel 1 is coated with a slurry prepared by dispersing phosphor particles of each color together with PVA, a surfactant, pure water, etc., followed by drying, selectively exposing to light in a predetermined pattern, and developing the pattern. These three phosphor layers may be in the form of either a stripe or dots, though the phosphor layers consist of dots in the embodiment shown in the drawing. A shadow mask 4 having a large number of electron beam-passing holes formed therein is arranged inside the phosphor screen 3 in a manner to face the phosphor screen 3. Also, an electron gun 6 for emitting an electron beam toward the phosphor screen 3 is arranged inside a neck 5 of the funnel 2. The electron beam emitted from the electron gun 6 impinges against the phosphor screen 3 to excite the three phosphor layers so as to cause these phosphor layers to emit light of three colors. Also, a conductive antireflection film 7 comprising a conductive layer and an insulating covering layer is formed on the panel 1. The film 7 includes a conductive member 8 extending through the covering layer and connected at one end to the conductive layer.

Figure 2:
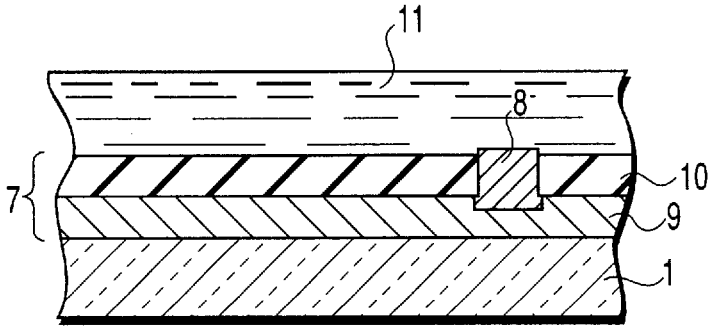
FIG. 2 is a cross sectional view showing as an example the construction of an antireflection film of the present invention.
Figure 3:
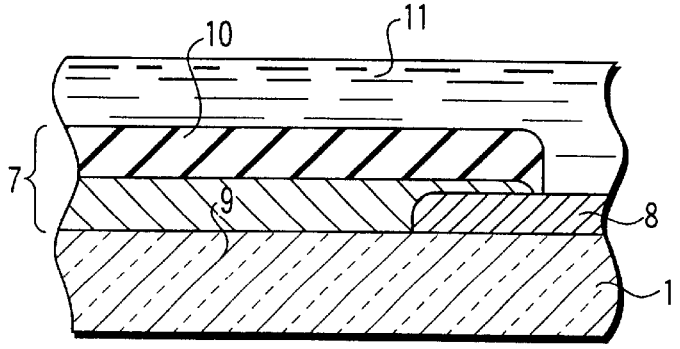
FIG. 3 is a cross sectional view showing as another example the construction of an antireflection film of the present invention.

Let us describe how to manufacture the conductive antireflection film with reference to FIGS. 2 and 3 each showing a cross section of the conductive antireflection film 7 shown in FIG. 1.

As shown in FIG. 2, a conductive layer 9 containing fine particles of Ag is formed first on the outer surface of the panel 1 made of, for example, glass. Then, an insulating covering layer 10 containing $SiO_2$ as a main component is formed to cover the entire surface of the conductive layer 10, followed by baking the laminate structure consisting of the conductive layer 10 and the covering layer 9. After the baking step, soldering is applied by using an ultrasonic soldering device "Sunbonder", trade name of an ultrasonic soldering machine manufactured by Asahi Glass K.K. Japan, to bury the conductive member 8 such that the conductive member 8 is electrically connected at one end to the conductive layer 9 and exposed at the other end to the outside.

FIG. 3 shows another embodiment. In this embodiment, the conductive member 8 made of, for example, ITO is formed in advance on the surface of the panel 1, e.g., on the outer peripheral portion of the panel 1. Then, the conductive layer 9 is formed in an inner region on the surface of the panel 1 such that the outer peripheral portion of the conductive layer 9 is in contact with a part of the conductive member 8, followed by baking to permit the conductive member 8 to be electrically connected to the conductive layer 9. Further, an insulating covering layer 10 is formed to cover the entire surface of the conductive layer 9 with the conductive member 8 partly exposed to the outside.

After the conductive member 8 connected to the conductive layer 9 is partly exposed to the outside as shown in FIG. 2 or 3, an electrolytic solution 11 is brought into contact with the conductive member 8. In this step, the electrolytic solution 11 should not be in direct contact with the conductive layer 9. If the electrolytic solution 11 is brought into direct contact with the conductive layer 9, a difficulty is brought about such that the fine particles of a metal such as Ag contained in the conductive layer react with the electrolytic solution 11. It is necessary to select a material stable against the electrolytic solution 11 for forming the conductive member 8. Also, it is desirable to form the covering layer 10 in tight contact with the conductive member 8 so as to eliminate clearances through which the electrolytic solution 11 permeates.

If the electrolytic solution 11 is brought into contact with the conductive layer 9 through the conductive member 8, the conductivity of the conductive antireflection film is increased, leading to reduction in resistance. Also, the transmittance of light having a wavelength of 400 to 500 nm is increased, with the result that the antireflection film exhibits a neutral transmittance.

The mechanism of the particular phenomenon has not yet been clarified sufficiently. However, the present inventors interpret the particular phenomenon as follows.

Specifically, the improvement in the electrical conductivity of the conductive antireflection film and the increase in the transmittance of light having a wavelength of 400 to 500 nm take place only where the electrolytic solution is brought into contact with the conductive layer. This suggests that the metal ion, e.g., $Ag^+$, generated in the conductive layer in the processes of forming the conductive layer and the covering layer is reduced into the metal under an electrical function. In addition, the metal formed by the reduction is arranged as fine particles within the fine particles of the metal contained in advance in the conductive layer so as to improve the electrical conductivity of the conductive layer. Also, further fine metal particles are formed in a manner to fill the clearances of the fine metal particles contained in advance in the conductive layer so as to suppress the light scattering, leading to an increased transmittance of light having a wavelength of 400 to 500 nm.

In the embodiments described above, the cathode ray tube of the present invention is directed to a color cathode ray tube. Needless to say, however, the technical idea of the present invention can also be applied to a monochromatic cathode ray tube.

EXAMPLE 1

A glass plate sized at 10 cm×10 cm was washed and, then, heated to about 45° C., followed by coating one surface of the glass plate by using a spinner with a dispersion prepared by dispersing Ag fine particles having an average particle diameter of 30 nm. Then, the solvent was evaporated from the dispersion coated on the glass plate so as to form a conductive layer.

In the next step, the conductive layer was coated with an alkoxide solution of Si by using a spinner, followed by evaporating the solvent from the coated alkoxide solution so as to form an insulating covering layer. Then, the conductive layer and the covering layer were baked at 210° C. for 30 minutes so as to form a laminate structure of a double layer structure.

Then, a solder layer was formed by using "Sunbonder" referred to previously, thereby forming a conductive member connected at one end to the conductive layer and exposed at the other end to the outside, as shown in FIG. 2.

Then, the glass plate having the conductive member formed thereon was dipped for one hour in a 1% NaCl solution, followed by washing the glass plate with pure water so as to remove sufficiently the NaCl solution. Finally, the glass plate was dried so as to obtain a conductive antireflection film.

Similarly, various antireflection films having conductive layers differing from each other in thickness were prepared by changing the rotating speed of the spinner within a range of between 80 rpm and 250 rpm in the step of coating the entire surface of the glass plate with a dispersion of Ag fine particles.

Each of the conductive antireflection films thus prepared was found to exhibit a luminous reflectance of 0.3%, supporting a sufficient antireflection effect. The conductive antireflection film was also found to exhibit a resistance of 30Ω and a transmittance at that time of 80%, supporting that the film had a high conductivity sufficient for preventing leakage of electromagnetic wave.

Figure 4:
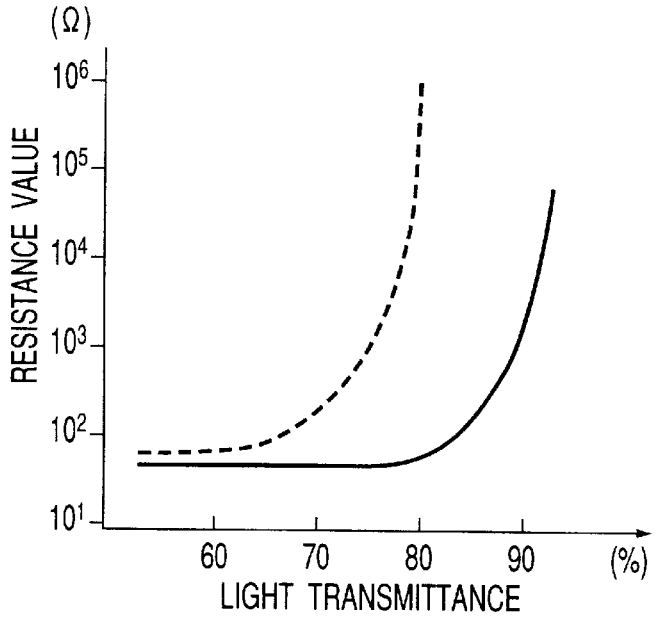
FIG. 4 is a graph showing the relationship between the electrical resistance of the conductive antireflection film and the light transmittance.
Figure 5:
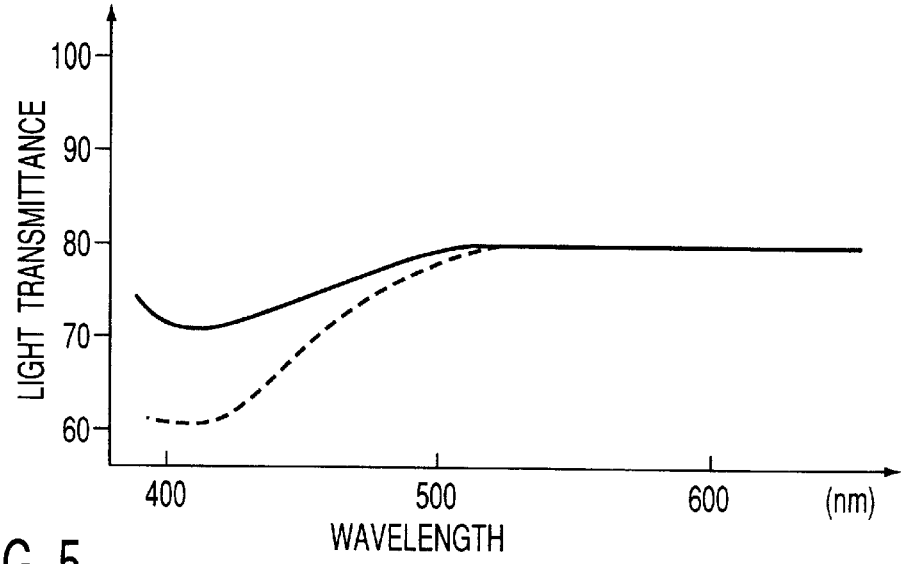
FIG. 5 is a graph showing the relationship between the wavelength and transmittance of light.

A solid line in a graph of FIG. 4 represents the relationship between the resistance value and the light transmittance of the conductive antireflection films having conductive layers differing from each other in thickness. On the other hand, FIG. 5 is a graph showing the relationship between the wavelength and transmittance of light.

COMPARATIVE EXAMPLE 1

A conductive antireflection film was formed on a glass plate as in Example 1, except that the treatment with a 1% NaCl solution was not applied after formation of the conductive member.

The resistance of the resultant conductive antireflection film was found to be $1\times10^6\Omega$, indicating that the film was inferior in electrical conductivity to the conductive antireflection film of Example 1 and that the film might be incapable of preventing sufficiently the leakage of an electromagnetic wave. In other words, the antireflection film was low in electrical conductivity, though the film was formed as in Example 1 except that the treatment with an electrolytic solution was not employed in the process of preparing the antireflection film.

Further, various antireflection films having conductive layers differing from each other in thickness were prepared by changing the rotating speed of the spinner within a range of between 80 rpm and 250 rpm in the step of coating the entire surface of the glass plate with a dispersion of Ag fine particles similar to that used in Example 1.

A broken line shown in the graph of FIG. 4 represents the relationship between the resistance value and the light transmittance of the resultant conductive antireflection films. Similarly, a broken line shown in the graph of FIG. 5 represents the relationship between the wavelength and transmittance of light.

As apparent from FIG. 4, the conductive antireflection film prepared by the method of the present invention, which is denoted by the solid line, exhibits an electrical resistance lower than that of the conductive antireflection film prepared by the conventional method, which is denoted by a broken line, where the conductive antireflection films have the same light transmittance. Particularly, the difference in the electrical resistance between the two is markedly increased with increase in the light transmittance. It should be noted that, if the light transmittance is not higher than 75%, a surface resistance value of $1\times10^3\Omega$ or less, which is effective for preventing leakage of an electromagnetic wave, can be obtained in the Comparative Example. In the Example of the present invention, however, the same surface resistance value can be obtained under the light transmittance of about 90% and more smaller surface resistance value of $1\times10^2\Omega$ can be obtained under the light transmittance of about 80%.

Further, FIG. 5 shows that the conductive antireflection film prepared by the method of the present invention, which is denoted by the solid line, exhibits a high light transmittance, compared with the conductive antireflection film prepared by the conventional method, which is denoted by the broken line. Particularly, the light transmittance of the conductive antireflection film prepared by the method of the present invention is markedly higher than that of the film prepared by the conventional method where the wavelength of light falls within a range of between 400 nm and 500 nm.

As apparent from the experimental data, the conductive antireflection film of Example 1 was found to exhibit a low resistance value, or improved electrical conductivity, compared with the conductive antireflection film of Comparative Example 1, making it possible to prevent effectively the electromagnetic wave from leaking to the outside.

It has also been found that the conductive antireflection film of the present invention permits markedly improving the light transmittance, particularly where the wavelength of light falls within a range of between 400 nm and 500 nm, making it possible to prevent the body color from being made yellowish. It follows that a clear image can be obtained in the cathode ray tube of the present invention.

An additional experiment was conducted by using a 1% solution of each of KCl, $BaCl_2$, $CaCl_2$, $MgCl_2$, $ZnCl_2$, $CrCl_3$, $FeCl_2$, and $CuCl_2$ in place of 1% NaCl solution, to obtain results similar to those in Example 1.

EXAMPLE 2

A panel having a diagonal length of 16 inches and containing $SiO_2$ as a main component was washed, followed by heating the panel to about 35° C. Then, the outer surface of the panel was coated by using a spinner with a dispersion of fine Ag particles, followed by evaporating the solvent of the dispersion so as to form a conductive layer.

In the next step, the conductive layer was coated by using a spinner with an alkoxide solution of Si, followed by evaporating the solvent of the coated alkoxide solution so as to form an insulating covering layer. Then, each of the conductive layer and the covering layer was baked at 210° C. for 30 minutes.

Further, a through-hole was formed in the covering layer in a manner to extend through the covering layer in its thickness direction. After formation of the through-hole, a solder layer was formed by using "Sunbonder" (trade name of an ultrasonic soldering machine manufactured by Asahi Glass K.K. Japan) to fill the through-hole, thereby forming a conductive member connected at one end to the conductive layer and exposed at the other end to the outside, as shown in FIG. 2.

Then, the glass plate having the conductive member formed thereon was dipped for one hour in a 1% NaCl solution, followed by washing the glass plate with pure water so as to remove sufficiently the NaCl solution. Finally, the glass plate was dried so as to obtain a conductive antireflection film.

The conductive antireflection films thus prepared was found to exhibit a luminous reflectance of 0.3%, supporting a sufficient antireflection effect. On the other hand, the conductive antireflection film was found to exhibit a resistance of 80Ω and a light transmittance of 80%.

Also, a phosphor screen was formed by the ordinary slurry method on the inner surface of the panel. Specifically, a photosensitive slurry was prepared first by adding a chromate compound of ammonium bichromate and polyvinyl alcohol to phosphor particles of each of three colors, followed by coating the inner surface of the panel with the resultant slurry by a rotary coating method and subsequently exposing selectively the coating to light in a desired pattern and developing the pattern so as to form the desired phosphor screen.

Finally, a cathode ray tube constructed as shown in FIG. 1 was assembled by the ordinary method by using the panel having the phosphor screen formed on the inner surface thereof.

COMPARATIVE EXAMPLE 2

A cathode ray tube was prepared as in Example 2, except that the treatment with a 1% NaCl solution was not performed after formation of the conductive member.

The conductive antireflection film thus prepared exhibited a luminous reflectance of 0.3%, supporting a sufficiently high antireflection effect. Also, the resistance value was $1\times10^3\Omega$, and the light transmittance was 80%.

The experimental data clearly support that the cathode ray tube of Example 2 permits markedly suppressing the leakage of an electromagnetic wave to the outside, compared with the cathode ray tube of Comparative Example 2.

Also, the contrast of the displayed image was measured for each of the cathode ray tubes prepared in Example 2 and Comparative Example 2. Incidentally, where "A" represents the intensity (brightness) of light emitted from within the cathode ray tube and transmitted to the outside through the panel, and "B" denotes the intensity (outer light reflectance) of light coming from the outside so as to be incident on the panel and reflected toward the outside of the panel, the contrast (Brightness Contrast Performance) is given by:

$$A1/A0/(B1/B0)^{1/2}$$

where, A1 and B1 represent the data on the cathode ray tube prepared in Example 2, and A0 and B0 represent the data on the cathode ray tube prepared in Comparative Example 2.

The results of the measurement were: A1=490 μA; B1=470 μA; A0=2.5%; B0=2.6%. Therefore, the contrast was found to be 1.02.

The experimental data clearly support that the cathode ray tube prepared in Example 2 makes it possible to obtain a clear image of a high contrast, compared with the cathode ray tube prepared in Comparative Example 2.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube, comprising:

a faceplate; and a conductive antireflection film including a conductive layer formed on said faceplate, an insulating covering layer formed on said conductive layer, and a conductive member formed in said insulating covering layer in a manner to extend from a surface of the insulating covering layer into said conductive layer, a part of said conductive member being electrically connected to the conductive layer and another part of said conductive member being exposed to an outside, wherein said conductive layer contains as main components fine particles of Ag and Ag alloy.

2. The cathode ray tube according to claim 1, wherein said conductive member is formed on that region of said faceplate in which a picture image is not formed.

3. The cathode ray tube according to claim 1, wherein said insulating covering layer contains $SiO_2$.

4. A method of manufacturing a conductive antireflection film, comprising the steps of:

forming a conductive layer on a substrate, wherein said conductive layer contains as main components fine particles of Ag and Ag alloy;

forming an insulating covering layer on said conductive layer;

forming a conductive member in said an insulating covering layer such that said conductive member extends from a surface of the insulating covering layer into said conductive layer so as to bring at least a part of said conductive member into electric contact with the conductive layer, with another part of the conductive member exposed to an outside;

bringing an electrolytic solution into contact with the exposed part of said conductive member; and removing said electrolytic solution.

5. The method according to claim 4, wherein said insulating covering layer contains $SiO_2$.

6. The method according to claim 4, wherein said electrolytic solution contains at least one ion selected from the group consisting of $K^+$, $Ba^{2+}$, $Ca^{2+}$, $Na^+$, $Mn^{2+}$, $Zn^{2+}$, $Cr^{3+}$, $Fe^{2+}$ and $Cu^{2+}$.

7. The method according to claim 4, wherein said electrolytic solution contains at least one ion selected from the group consisting of $K^+$, $Ba^{2+}$, $Ca^{2+}$, $Na^+$, $Mn^{2+}$, $Zn^{2+}$, $Cr^{3+}$, $Fe^{2+}$, $Cu^{2+}$ and $Cl^-$.

8. A method of manufacturing a conductive antireflection film, comprising the steps of:

forming a conductive layer on a substrate having a conductive member formed therein in advance such that said conductive layer is brought into contact with a part of said conductive member, wherein said conductive layer contains as main components fine particles of Ag and Ag alloy;

forming an insulating covering layer to cover said conductive layer and said conductive member except another part of said conductive member to permit said another part of the conductive member to be exposed to an outside;

bringing an electrolytic solution into contact with the exposed part of said conductive member; and removing said electrolytic solution.

9. The method according to claim 8, wherein said insulating covering layer contains $SiO_2$.

10. The method according to claim 8, wherein said electrolytic solution contains at least one ion selected from the group consisting of $K^+$, $Ba^{2+}$, $Ca^{2+}$, Na+, $Mn^2$+, $Zn^2$+, $Cr^3$+, $Fe^2$+and $Cu^2$+.

11. The method according to claim 8, wherein said electrolytic solution contains at least one ion selected from the group consisting of $K^+$, $Ba^{2+}$, $Ca^{2+}$, $Na^+$, $Mn^{2+}$, $Zn^{2+}$, $Cr^{3+}$, $Fe^{2+}$, $Cu^{2+}$ and $Cl^-$.

* * * * *